US006568567B2

(12) United States Patent
McKenzie et al.

(10) Patent No.: US 6,568,567 B2
(45) **Date of Patent: *May 27, 2003**

(54) BULK-SOLID METERING SYSTEM WITH LATERALLY REMOVABLE FEED HOPPER

(75) Inventors: James J. McKenzie, Whitewater, WI (US); Peter Ahlmer, Darmstadt (DE); Harald Heinrici, Biebesheim (DE); Joseph E. Deklotz, Pewaukee, WI (US)

(73) Assignee: Schenck AccuRate, Inc., Whitewater, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/248,055

(22) Filed: Feb. 10, 1999

(65) Prior Publication Data

US 2001/0017303 A1 Aug. 30, 2001

(51) Int. Cl.[7] ..... B67D 5/06

(52) U.S. Cl. ..... 222/181.1; 222/198; 222/236; 222/413

(58) Field of Search ..... 222/413, 202, 222/181.1, 236, 198; 220/684, 686, 681, 614; 366/261, 331, 255, 256, 285, 286, 156.1, 156.2

(56) References Cited

U.S. PATENT DOCUMENTS 1,090,120 A * 3/1914 Scott
2,858,051 A 10/1958 Cunningham
3,011,768 A * 12/1961 Clark ..... 366/285
3,093,271 A * 6/1963 Douglas
3,135,432 A * 6/1964 McKinney
3,253,745 A 5/1966 Skelton ..... 222/56
3,257,040 A * 6/1966 Dumbaugh et al.
3,408,876 A * 11/1968 Andrews
3,473,702 A * 10/1969 Molitor ..... 222/203
3,494,507 A 2/1970 Ricciardi ..... 222/36
3,598,286 A * 8/1971 Wardell
3,804,298 A 4/1974 Ricciardi ..... 222/56
3,913,794 A * 10/1975 Dale ..... 222/413
3,941,284 A * 3/1976 McLean
4,164,244 A 8/1979 Meier
4,187,961 A 2/1980 Voller
4,201,484 A * 5/1980 Sasiela et al. ..... 366/153.1
4,378,897 A 4/1983 Kattelmann (List continued on next page.)

OTHER PUBLICATIONS

Diamondback Technology News by JR Johanson Inc., San Luis Obispo, CA, Est. 10/98 (4 Pages).

Jenike & Johanson Hopper Design Reference by Jenike & Johanson, Westford, MA, Est. 12/94 (2 Pages).

*Primary Examiner*—Christopher Kim
(74) *Attorney, Agent, or Firm*—Jansson, Shupe & Munger, Ltd

(57) ABSTRACT

A bulk-solid metering system has a support structure. A feed hopper is mounted with respect to the structure and has an upper edge. In the improvement, the structure includes an upper member and the upper edge is below such upper member. The structure defines a lateral opening sized and shaped to permit the feed hopper to be withdrawn laterally through the opening. The feed hopper includes a spout extending therefrom. In a highly preferred embodiment, the lateral opening is positioned to permit withdrawal of the feed hopper in a direction away from the spout. The feed hopper is configured to promote very good mass flow as well as to permit agitation in that, in one embodiment, it has a body made of flexible material. There is a hopper upper flange and the spout is spaced below such flange. The body has a first cross-sectional shape, e.g., circular, adjacent to the upper flange and has a second cross-sectional shape, e.g., ellipse-like, intermediate the upper flange and the spout.

19 Claims, 9 Drawing Sheets

U.S. PATENT DOCUMENTS 4,715,515 A * 12/1987 Steilen
4,804,111 A 2/1989 Ricciardi et al. ..... 222/77
4,810,156 A 3/1989 Pendleton et al.
4,958,741 A 9/1990 Johanson ..... 220/83
4,983,090 A 1/1991 Lehmann et al. ..... 414/326
5,110,015 A 5/1992 Kilts
5,141,135 A 8/1992 Volk, Jr.
5,201,473 A 4/1993 Pollock ..... 241/36
5,215,228 A 6/1993 Andrews et al. ..... 222/203
5,222,634 A * 6/1993 Hayes ..... 222/185.1
5,265,763 A * 11/1993 Heinrici et al.
5,289,955 A 3/1994 Sulenski
5,301,844 A 4/1994 Ricciardi ..... 222/199
5,361,945 A 11/1994 Johanson ..... 222/145
5,423,455 A 6/1995 Ricciardi et al.
5,450,984 A 9/1995 Rohr
5,617,975 A * 4/1997 Johanson et al.
5,655,692 A 8/1997 Navin et al.
5,699,730 A 12/1997 Ogier et al.
5,788,449 A 8/1998 Riemersma

* cited by examiner

FIG. 2
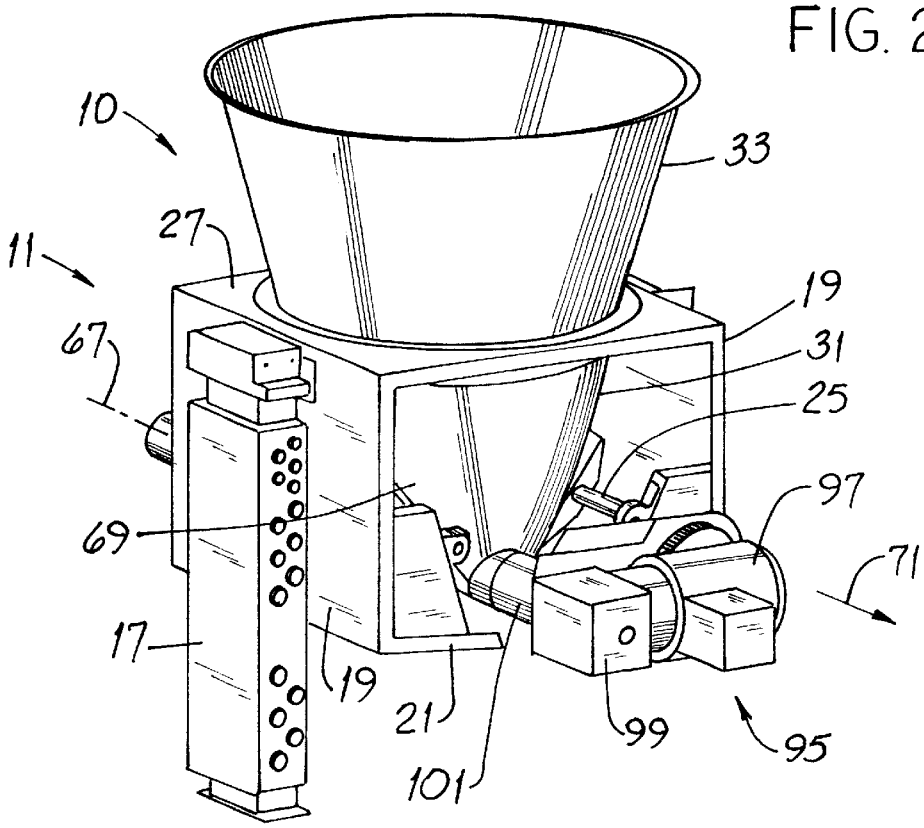
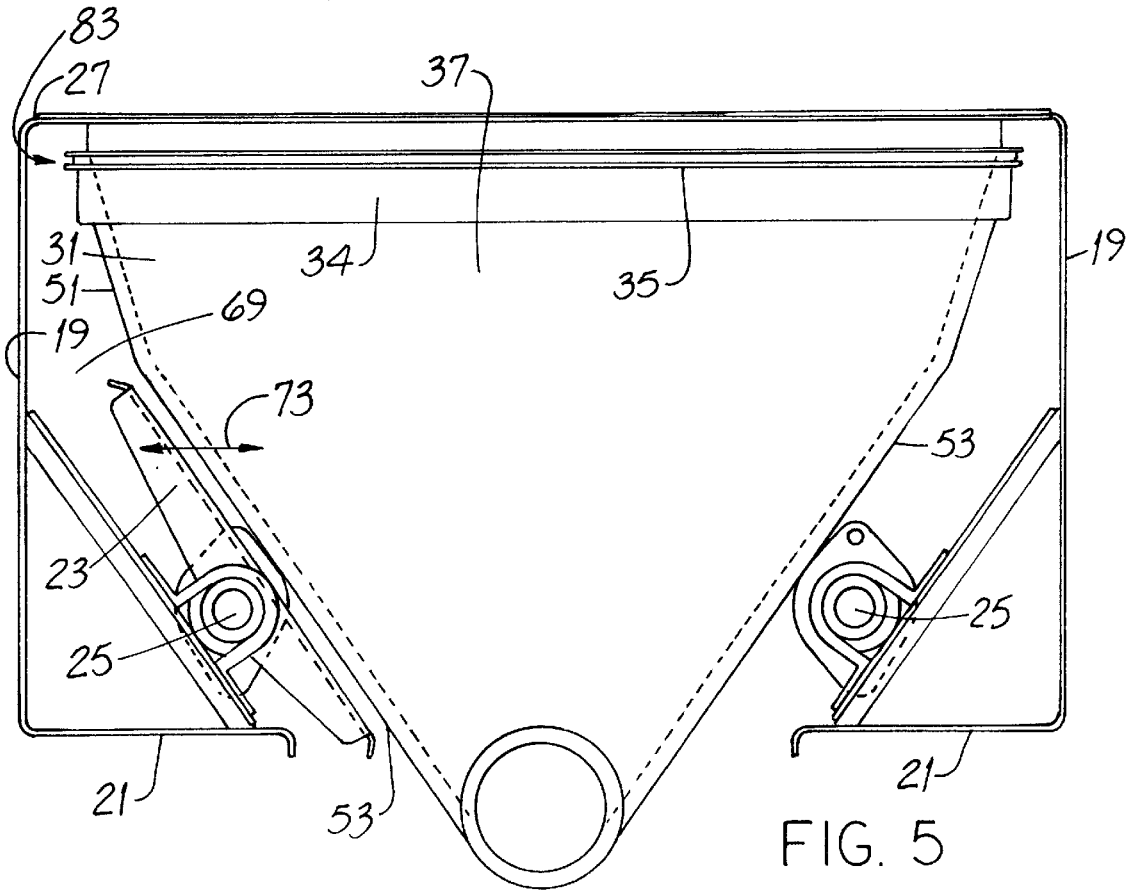
FIG. 5

BULK-SOLID METERING SYSTEM WITH LATERALLY REMOVABLE FEED HOPPER

FIELD OF THE INVENTION

This invention relates to bulk material handling systems and, more particularly, such systems having a static container and means to move material from such container.

BACKGROUND OF THE INVENTION

Bulk-solid metering systems are used to feed finely divided (powdered or granular) material into processing equipment. The processing equipment fed by the metering system (or plural metering systems) uses the material as the sole constituent or as one of the constituents in the intermediate or final product to be made. For reasons that will become apparent, it is important that a bulk-solid metering system deliver a precisely-measured amount of material for each unit, e.g., minute or hour, of operating time. Sophisticated gravimetric and volumetric measuring systems have been developed to help assure the bulk-solid metering system performs in this way. Examples of bulk-solid metering systems are disclosed in U.S. Pat. Nos. 4,804,111 (Ricciardi et al.); 4,983,090 (Lehmann et al.); 5,201,473 (Pollock); 5,215,228 (Andrews et al.) and 5,301,844 (Ricciardi et al.) while hoppers and mass flow bins which might be used in such systems are disclosed in U.S. Pat. Nos. 4,958,741 (Johanson) and 5,361,945 (Johanson).

As but one example of how bulk-solid metering systems are used, a commercial bakery may employ several bulk-solid metering systems to feed one or more types of flour and other ingredients into a large machine for mixing bread dough. It is not unusual to automate the installation so that the operator can program which metering systems are to be operated and the feed rates therefor in order to make a particular type of bread.

As another example, a manufacturer of pharmaceutical products, e.g., cold tablets, may use plural bulk-solid metering systems to feed active and inert ingredients to a powder mixer. In turn, the powder mixer feeds what might be termed a pelletizing machine, the final output product of which is tablets.

Conventional bulk-solid metering systems are characterized by a support structure to which is secured a cone-like, wide-mouth feed hopper. At what might be termed its lower apex, such hopper has a conveyor embodied as a screw or auger rotating in a duct. The auger feeds the material in the hopper outwardly through the duct and the hopper spout to the processing equipment. The hoppers may be made of rigid or flexible substance and, if made of the latter, the system also includes paddles to agitate the hopper and help assure continuous flow of material in the hopper.

Very commonly, there is an extension hopper mounted to and above the feed hopper. The extension hopper increases the overall hopper capacity and where the hoppers are filled by batch filling from, e.g., an overhead crane, using two hoppers is significantly more efficient.

And while perhaps less common, it is not at all unusual to find a bulk-solid metering system in which the extension hopper is connected by a large tube to a bulk storage silo not unlike those found on farms. The silo holds a very large quantity of the material being metered by the system and is used to periodically "recharge" the hoppers so that the bulk-solid metering system can run continuously for long periods of time.

While these earlier systems have been generally satisfactory for their intended purposes, they are not without disadvantages. Inevitably, repairs or other maintenance must be performed. In a conventional arrangement, the extension hopper must first be detached and lifted away from the system. Then the nozzle leading to the process equipment (such nozzle being connected to the feed hopper spout) is disconnected. Then the feed hopper auger and, depending upon the specific configuration, the auger drive are disconnected. Finally, the feed hopper is detached from and lifted upwardly out of the support structure for service. Disconnection and disassembly time is very substantial; the point, of course, is that during downtime, the user is not being availed of the value of the system.

Another disadvantage of certain known systems is that to a certain degree, the feed hopper is configured with ease of system fabrication and ease of hopper sidewall agitation in mind. These considerations are evidenced by hopper shape which, in horizontal cross-section, is rectangular along substantially the entire hopper height. Fabrication is easy since the feed hopper support frame is, itself, likely to be rectangular. And flat hopper sidewalls are or may be easier to make than curved sidewalls. Further, external agitation paddles work well against flat sidewalls. Considered from an ease-of-fabrication standpoint, a rectangular-section hopper is very easy to "transition" from a wide rectangular mouth to the narrow slot-like opening in which the conveying auger is mounted.

However, rectangular hoppers work somewhat poorly at promoting what is known as "mass flow." Finely divided material in the hopper tends to "hang up" along the straight-line seams formed at the junction of two contiguous flat sidewalls. This can impair the feed-rate accuracy of the system.

And that is not all. Where a rectangular extension hopper is used with a rectangular feed hopper, the "transition" joint between the two hoppers is difficult to seal. Further, rectangular extension hoppers are susceptible to side wall buckling due to high "hydrostatic" pressure from the finely divided bulk material therein. (The study of the mass flow characteristics of finely divided materials and of hoppers used to hold them is no trivial matter. Numerous, highly complex technical papers have been written on the subject.)

And in the manufacture of certain food and pharmaceutical products, it is highly preferred to have the feed hopper substantially free of material from the previous batch before the next batch is "charged" into such hopper. Some types of food and pharmaceutical materials deteriorate over time; "first in, first out" material management helps avoid incorporating deteriorated material into the product being made.

An improved bulk-solid metering system which addresses disadvantages of earlier systems would be a significant advance in this field of technology.

OBJECTS OF THE INVENTION

An object of the invention is to provide an improved bulk-solid metering system which addresses problems and shortcomings of earlier systems.

Another object of the invention is to provide an improved bulk-solid metering system which simplifies certain aspects of system repair and maintenance.

Another object of the invention is to provide an improved bulk-solid metering system which better promotes mass flow.

Yet another object of the invention is to provide an improved bulk-solid metering system which lends itself well to feed hopper agitation. How these and other objects are accomplished will become apparent from the following descriptions and from the drawings.

SUMMARY OF THE INVENTION

The invention involves a bulk-solid metering system of the type having a support structure and a feed hopper mounted with respect to the structure and having an upper edge. In the improvement, the structure includes an upper member and the upper edge of the feed hopper is below the upper member. The structure defines a lateral opening sized and shaped to permit the feed hopper to be withdrawn laterally through the opening.

A significant advantage of the arrangement is that the feed hopper can be serviced without removing any extension hopper which may be attached thereto. Another advantage is that if the feed hopper needs to be removed, the nozzle between the feed hopper spout and the process equipment being fed by the system need not be moved or, at most, needs only minimal time and effort to disconnect such nozzle from the hopper.

In more specific aspects of the invention, the support structure extends along a substantially vertical axis. The feed hopper includes a spout which extends from the hopper body along a first axis away from the vertical axis. The lateral opening is positioned to permit withdrawal of the feed hopper away from the vertical axis and along a second axis. Most preferably, the spout and the lateral opening are positioned with respect to one another so that the first axis and the second axis are about 180° apart. An advantage of this arrangement is that work can be performed at what might be termed the "operator side" of the bulk-solid metering system rather than from its "process side" where service-obstructing downstream process equipment is located.

In yet other aspects of the new system, the feed hopper may be made of a flexible material or of rigid sheet metal. In either instance, it is preferred that the system include a feed hopper agitator or stirring system, respectively. With a flexible feed hopper, two such agitators are usually used and they periodically "jar" or push against opposite sides of the body of the feed hopper to help keep the material therein from "bridging" or "ratholing" and impairing smooth flow. The agitators are mounted for reciprocating movement along an agitator axis angled with respect to the second axis. In a specific embodiment, the agitator axis and the second axis are substantially perpendicular to one another.

Yet other aspects of the new system relate to the ability to remove the feed hopper without removing the extension hopper. An extension hopper mounted in material-feeding relationship to the feed hopper and the hoppers are joined to one another at a hopper joint. The hopper joint is below the upper member of the support structure. The feed hopper includes an upper or first flange, the extension hopper includes a second flange and a securing device is in overlapping relationship to the flanges, thereby fastening the hoppers to one another. In a highly preferred embodiment, the securing device is a circular hoop which overlaps with and engages both flanges.

For optimum mass flow characteristics and agitation capability, the body of the feed hopper is made of a flexible material. The first flange is made of a rigid material and is secured to the hopper body by such flexible material. That is, the rigid first flange is molded into the material which permanently bonds. A resilient sealing ring is compressed between the flanges and the extension hopper has a mounting member, e.g., a circular ring, removably affixed to the upper member of the support structure. When the system is so configured, the feed and extension hoppers can be easily joined to one another and, just as easily, the extension hopper can be removed from the support structure, if necessary.

Yet other aspects of the invention relate to hopper configurations. The extension hopper has an upper edge and a lower mouth and at any one of plural section planes taken between the upper edge and the lower mouth, the cross-sectional shape of the extension hopper is circular. In the feed hopper, its upper flange and its spout are spaced from one another with the conduit being below the upper flange. The feed hopper body has a first cross-sectional shape adjacent to the upper flange and has a second cross-sectional shape intermediate the upper flange and the spout. In a specific embodiment, the first cross-sectional shape is circular, thereby availing the user of very good mass flow characteristics. The second cross-sectional shape is other than circular in that it has a longitudinal axis and a lateral axis perpendicular to and shorter than the longitudinal axis. A specific cross-sectional shape is "race-track-like" in that it has rounded or half-circle ends joined by parallel straight sides. In a preferred embodiment, the longitudinal axis of the second cross-sectional shape is substantially parallel to the spout first axis.

Yet another aspect of the invention involves other components of the bulk-solid metering system. In a specific embodiment of such a system, the feed hopper includes a driven conveyor such as an auger. A conveyor drive unit, e.g., electric motor and speed reducer, is supported by the structure and mounted for movement between a conveyor drive position and a hopper-removing position.

In another embodiment, the feed hopper is made of a rigid material, e.g., stainless steel, rather than of a flexible material. In this embodiment, free flow of material in the feed hopper is promoted by a stirring mechanism within the hopper rather than by agitators outside the hopper. Such stirring mechanism is supported by the extension hopper and includes a drive unit, a stirring device and a power shaft extending between the drive unit and the stirring device. The power shaft is mounted for movement with respect to the feed hopper, thereby permitting the stirring device to be removed from the feed hopper.

In a more specific version of this embodiment, the drive unit and the power shaft are coupled to one another by a coupling. When the system is in use, the preferred coupling holds the stirring device at a predetermined location in the feed hopper and yet permits sliding movement of the power shaft in the drive unit.

But when it is desired to laterally withdraw the feed hopper for maintenance (or for other reasons), the sliding coupling also permits the power shaft to move upwardly through the drive unit. The system user can thereby raise the stirring device to the elevation necessary to "clear" the feed hopper as such hopper is withdrawn.

Other details of the invention are set forth in the following detailed description and in the drawings.

BRIEF DESCRIPTIONS OF THE DRAWINGS

FIG. 2 is a perspective view of the new bulk-solid metering system using a feed hopper made of flexible material and with the drive unit in the operating position.

FIG. 5 is an elevation view of a portion of the system shown in FIGS. 2–4. An agitator is omitted and surfaces of parts are shown in dashed outline.

DETAILED DESCRIPTIONS OF PREFERRED EMBODIMENTS

Before describing the new bulk-solid metering system 10, it will be helpful to have an understanding of some aspects of a prior art installation. Once those aspects are understood, the advantages of the invention will be better appreciated.

Figure 1:
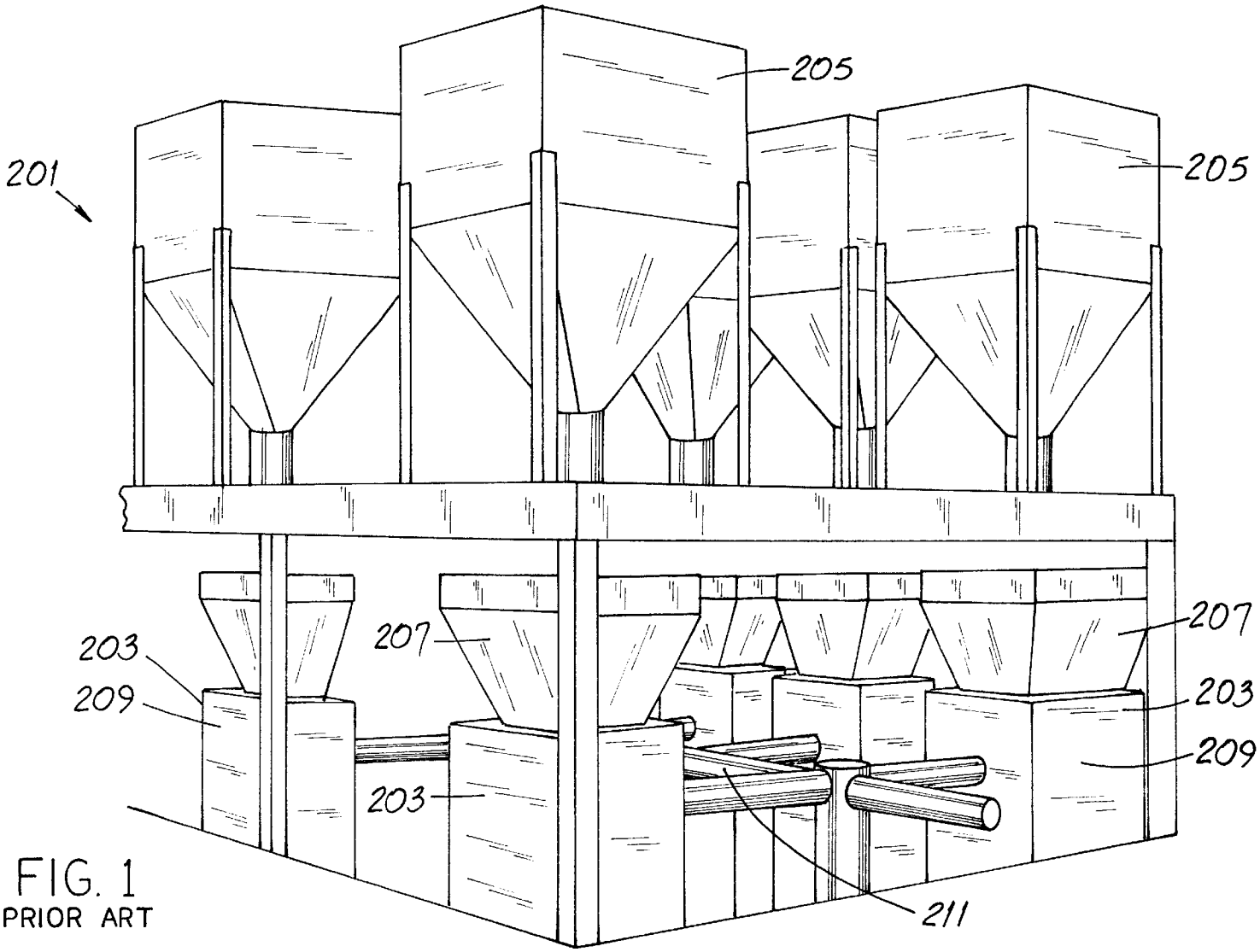
FIG. 1 PRIOR ART
FIG. 1 is a representative perspective view of a prior art process arrangement using conventional bulk-solid metering systems.
Figure 4:
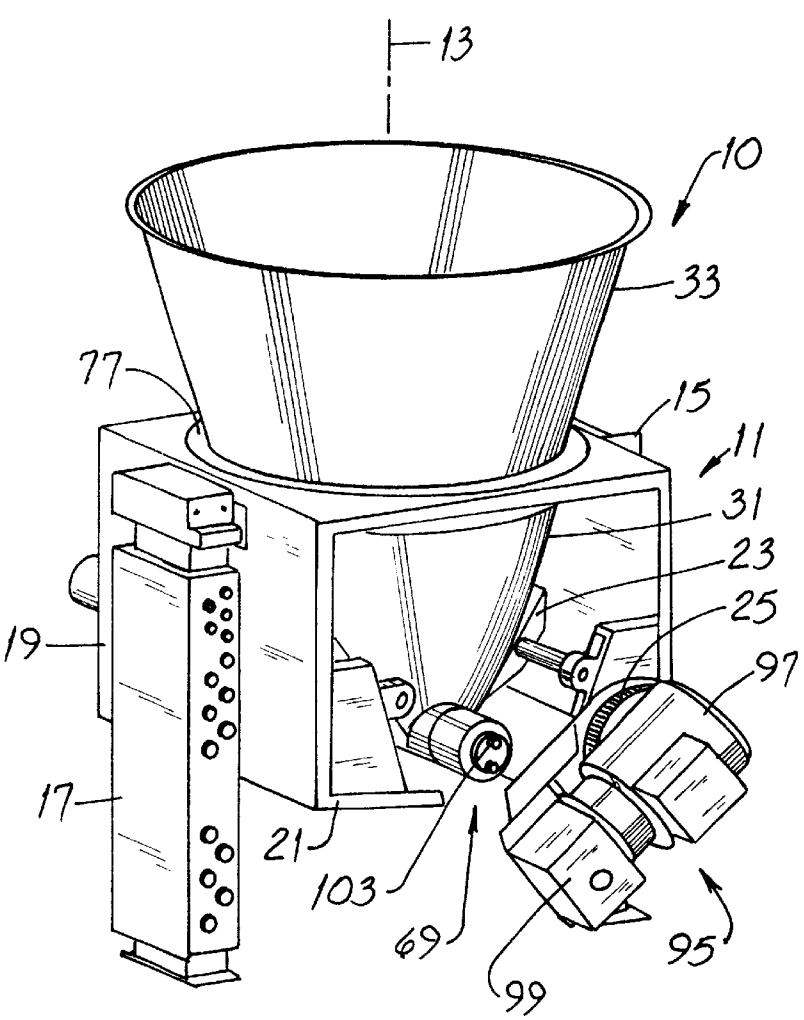
FIG. 4 is a perspective view, generally like that of FIG. 2, showing the bulk-solid metering system with the drive unit in the maintenance or service position.
Figure 3:
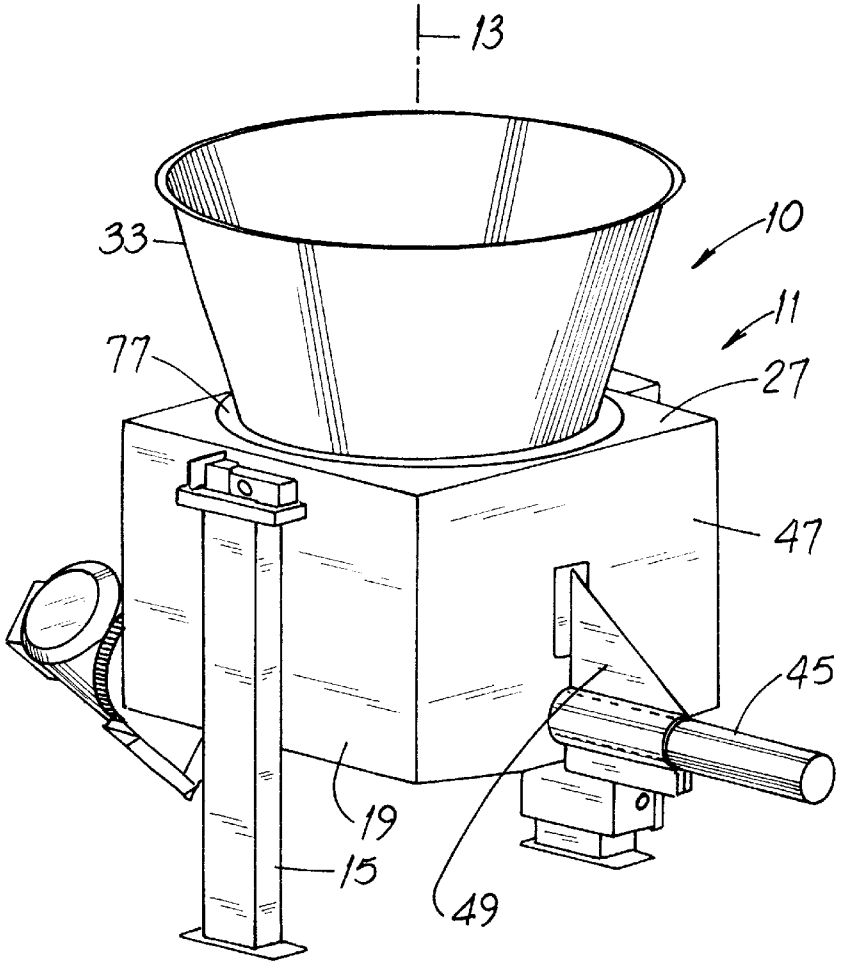
FIG. 3 is another perspective view of the new bulk-solid metering system.

FIG. 1 illustrates a prior art process arrangement 201 which has several bulk-solid metering systems 203 mounted side by side. Each such system 203 includes an auxiliary hopper 205 above a respective system feed hopper 207. The feed hoppers 207 extend downwardly into respective housings 209 and terminate in a spout in which an auger or other conveyor operates. Each auger urges material from a respective feed hopper 207 into a multi-branch pipeline 211 which feeds such material into the process equipment. Such equipment may be, e.g., mixing powder additives for paint, making multi-constituent pelletized products or the like.

From FIG. 1, it is apparent that in order to service a particular system 203 and, more notably, a particular feed hopper 207, the system 203, probably including the multi-branch pipeline 211, must be substantially dismantled. Such dismantling takes a good deal of time and labor. The arrangement 201 is inoperative and, therefore, unavailable for production during that time. Even if a process arrangement 201 includes but a single bulk-solid metering system 203, the advantages of the new system 10 are very significant, at least in terms of ease of maintenance and reduced downtime.

Referring next to FIGS. 2 through 5, the bulk-solid metering system 10 has a support structure 11 extending upwardly from the floor along a substantially vertical axis 13. The structure 11 comprises a pair of opposed support columns 15, 17, each coupled through a load cell housing (for gravimetric applications) or through a mounting block (for volumetric applications) to an opposed sidewall 19. Each sidewall 19 has a support pad 21 extending inwardly therefrom and such pads 21 and sidewalls 19 support reciprocating, opposed feed hopper agitators 23 and the drive mechanisms 25 therefor. An upper member 27 spans and is attached to the sidewalls 19 and has a central aperture 29 through it. The structure 11 also supports a feed hopper 31 and an extension hopper 33 in a manner described below.

Figure 6:
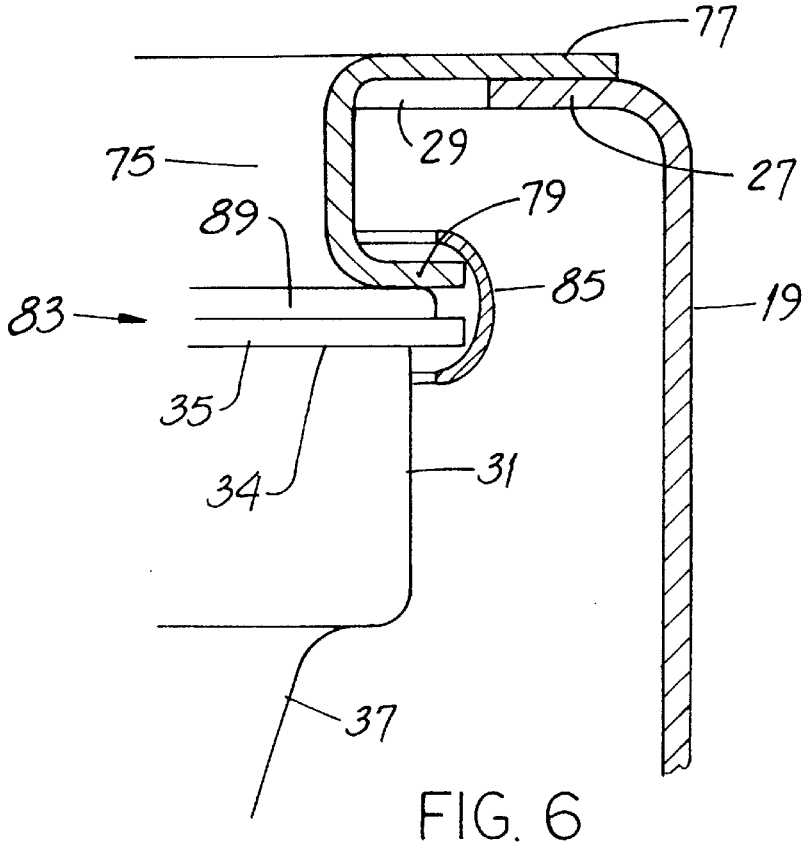
FIG. 6 is an elevation view, partly in section, of portions of the system support structure, feed hopper and extension hopper. Parts are broken away.
Figure 14:
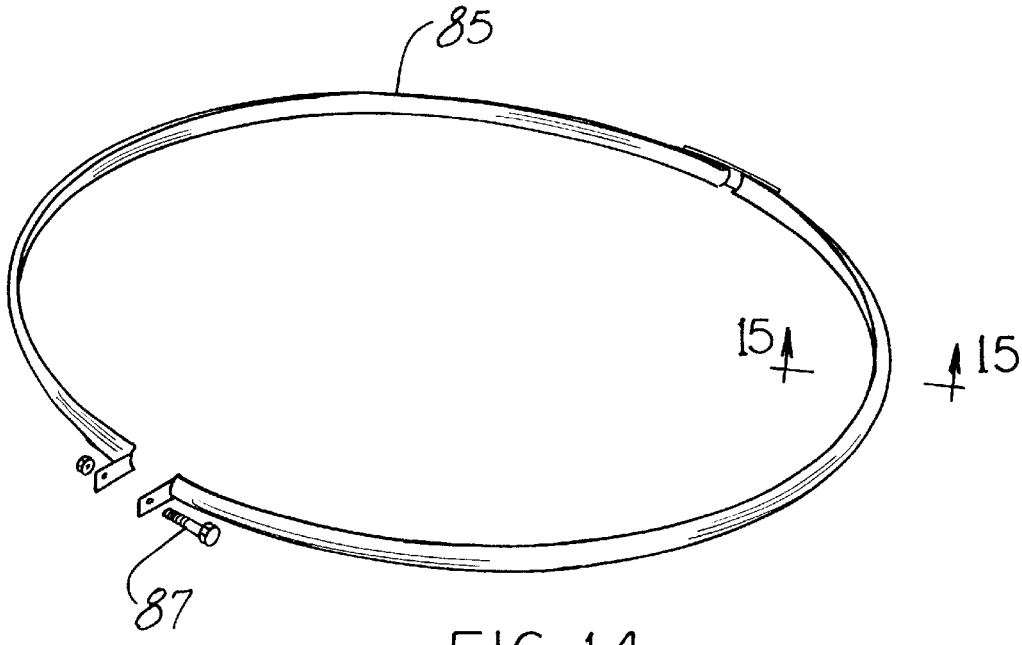
FIG. 14 is a perspective view of a securing device used in the new system.
Figure 7:
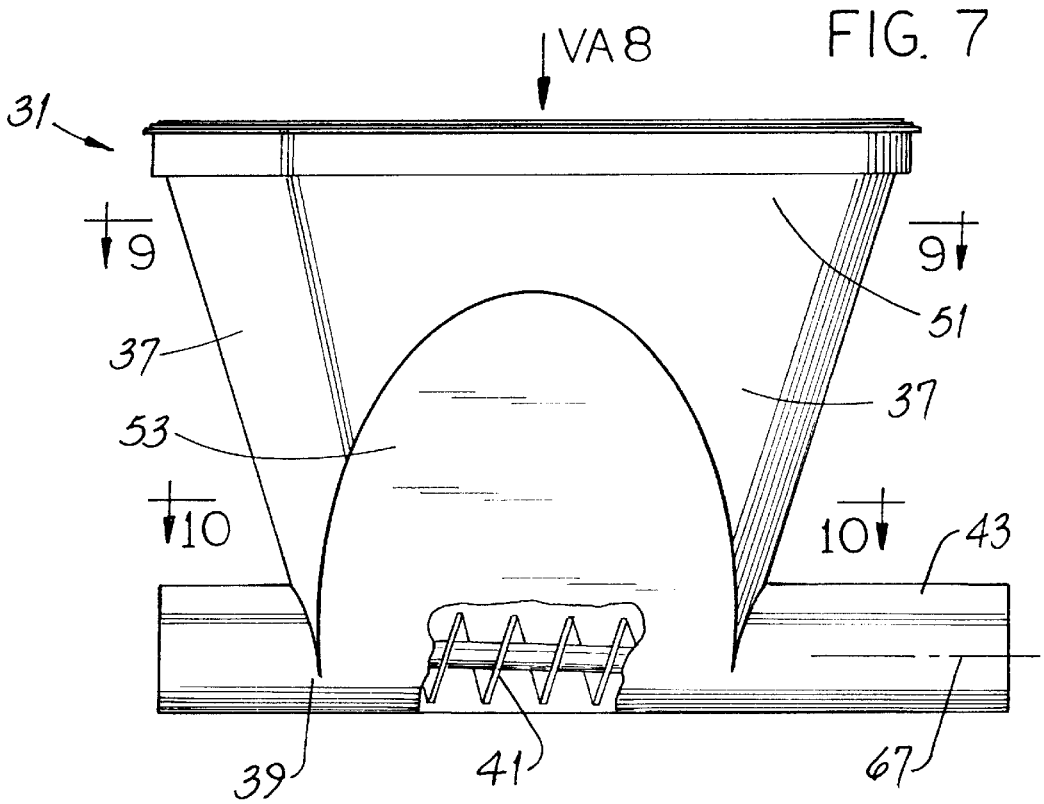
FIG. 7 is a side elevation view of one embodiment of a feed hopper used in the new system. Parts are broken away.
Figure 8:
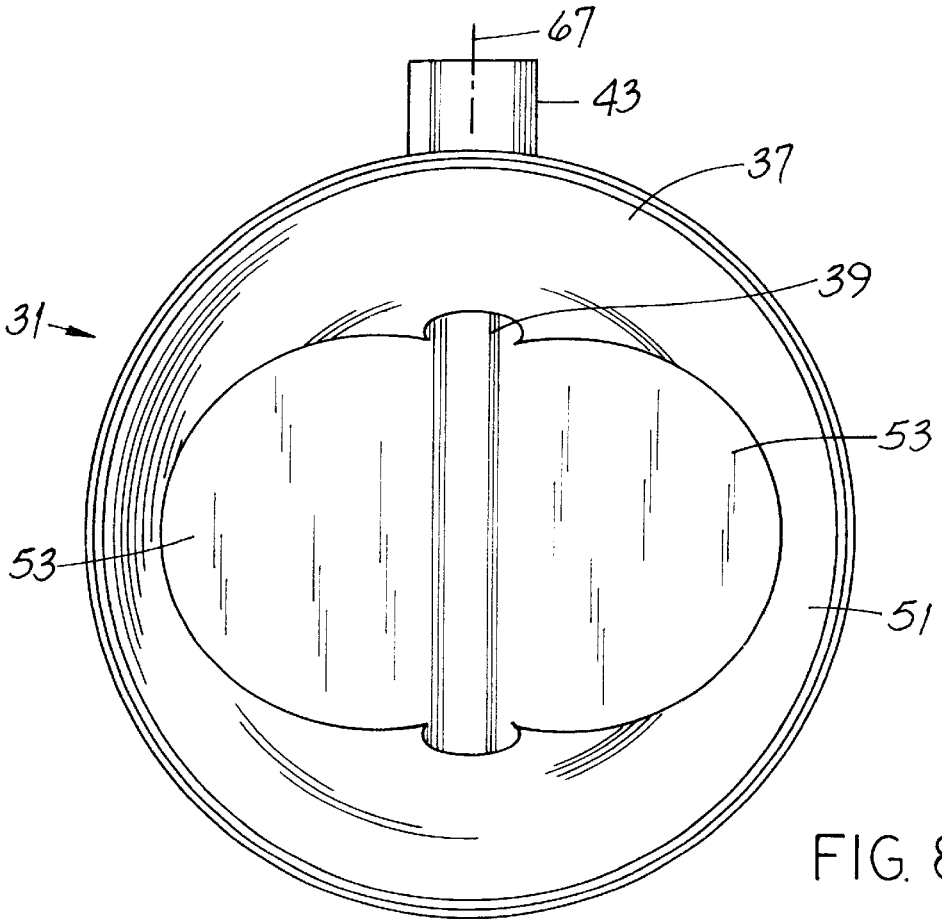
FIG. 8 is a top plan view of the feed hopper of FIG. 7 taken along the viewing axis VA8 thereof and rotated 90° about such axis. The auger in FIG. 7 is omitted in FIG. 8.

Referring also to FIGS. 6, 7 and 8, the feed hopper 31 has an upper edge 34 configured to include an upper or first flange 35. While the hopper body 37 is (in one embodiment) made of a flexible plastic material, the flange 35 is made of a rigid material, e.g., steel, which is molded into the plastic material. As particularly shown in FIGS. 5 and 6, the upper edge 34 of the feed hopper is spaced somewhat below the upper member 27.

The hopper body 37 tapers downwardly and inwardly to form a laterally extending duct 39 at the bottom of the hopper 31. The duct 39 is generally cylindrical and top-opening so the auger rotating in the duct 39 may receive the material flowing downwardly in the hopper and urge such material out of the hopper spout 43. An extension piece, often referred to as a nozzle 45, is attached to the spout 43 and secured on the structure wall 47 by a clamp 49. Material urged out of the spout 43 by the auger 41 flows along the nozzle 45 and to the process equipment in which the material is being used.

Figure 9:
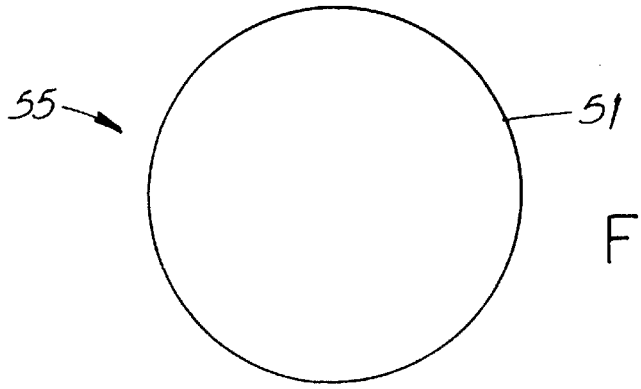
FIG. 9 is a section view, reduced in size, of the feed hopper of FIG. 7 taken along the section plane 9—9 thereof.
Figure 10:
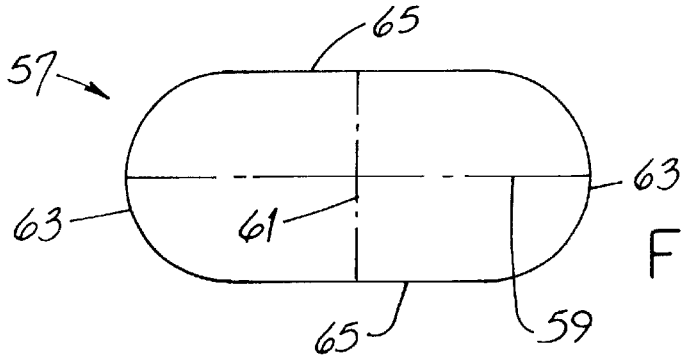
FIG. 10 is a section view, reduced in size, of the feed hopper of FIG. 7 taken along the section plane 10—10 thereof.
Figure 16:
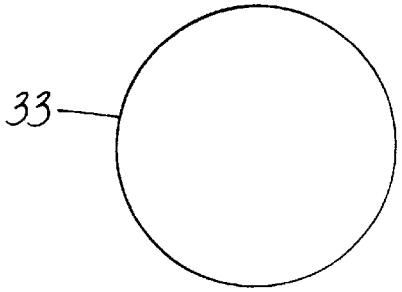
FIG. 16 is a section view, reduced in size, of the extension hopper of FIG. 11 taken along the section plane 16—16 thereof.
Figure 17:
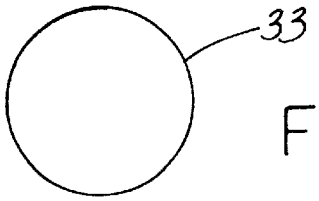
FIG. 17 is a section view, reduced in size, of the extension hopper of FIG. 11 taken along the section plane 17—17 thereof.
Figure 11:
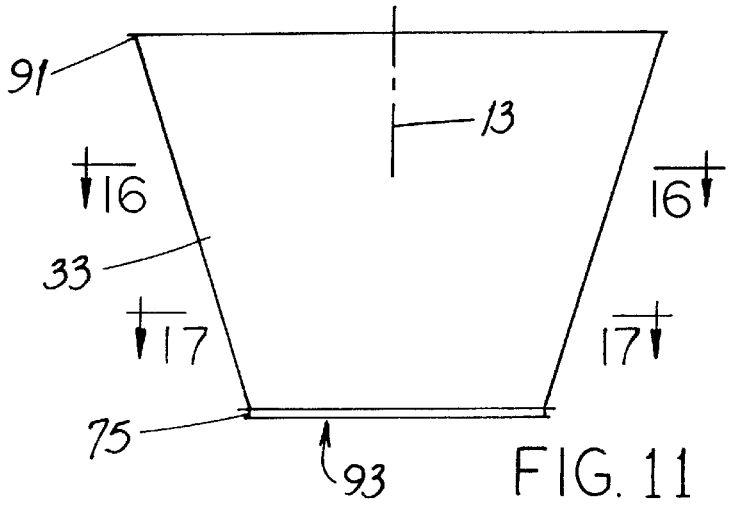
FIG. 11 is a representative elevation view of an extension hopper useful with the new system.
Figure 12:
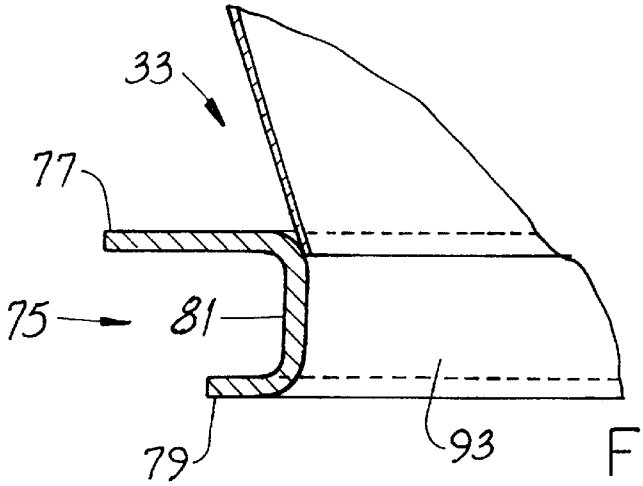
FIG. 12 is an enlarged sectional view of the lower mounting component of the hopper of FIG. 11. Parts are broken away and surfaces of parts are shown in dashed outline.
Figure 13:
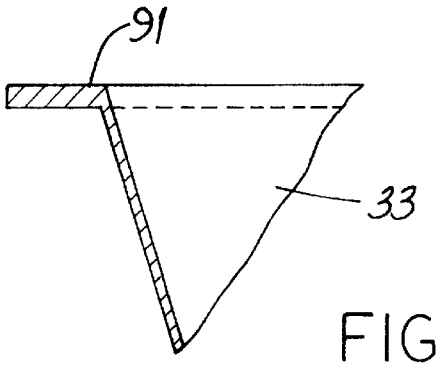
FIG. 13 is an enlarged sectional view of the upper edge of the hopper of FIG. 11. Parts are broken away and surfaces of parts are shown in dashed outline.
Figure 15:
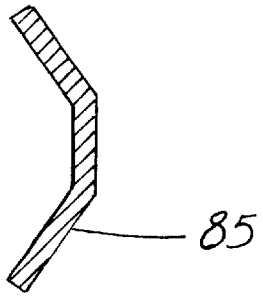
FIG. 15 is a sectional elevation view of the device of FIG. 14 taken along the section plane 15—15 thereof.

The feed hopper body 37 has a circular upper flow portion 51 and opposed, flat agitator portions 53 extending downwardly from the portion 51. Such body 37 has a first cross-sectional shape adjacent to the upper flange 35 and a second, different cross-sectional shape intermediate the upper flange and the spout. In a specific embodiment, the first cross-sectional shape 55 is circular (as shown in FIG. 9), thereby availing the user of very good mass flow characteristics. The second cross-sectional shape 57, shown in FIG. 10, is other than circular. In the specific embodiment, such shape 57 has a longitudinal axis 59 and a lateral axis 61 perpendicular to and shorter than the longitudinal axis 59. Such shape 57 is "race-track-like" in that it has rounded or half-circle ends 63 joined by parallel straight sides 65. In a preferred embodiment, the longitudinal axis 59 of the second cross-sectional shape 57 is substantially parallel to the spout axis 67, also referred to herein as the spout first axis 67.

Referring again to FIGS. 2, 4 and 5, the support structure 11 defines a lateral opening 69 sized and shaped to permit the feed hopper 31 to be withdrawn laterally through the opening 69. The opening 69 is positioned to permit withdrawal of the feed hopper 31 away from the vertical axis 13 and along a second axis 71. Most preferably, the spout 43 and the lateral opening 69 are positioned with respect to one another so that the first axis 67 and the second axis 71 are about 180° apart.

The system 10 includes a feed hopper agitator 23 and, usually, two such agitators 23 (one of which is omitted in FIG. 5) which periodically "jar" or push against opposite portions 53 of the flexible body 37. Such agitation helps keep the material in the hopper 31 from "bridging" or "ratholing" and impairing smooth flow. The agitators 23 are mounted for reciprocating movement along an agitator axis 73 angled with respect to the second axis 71 and, most preferably, perpendicular to and spaced above such second axis 71. It is to be appreciated that the agitator portions 53 are flat. Since the agitators 23 can be positioned (in their sequence of positions assumed during agitation) so that such agitators 23 are spaced slightly from the portions 53 to provide clearance for the hopper 31, the presence of the agitators 23 does not impair lateral withdrawal of the hopper 31.

Yet other aspects of the new system 10 relate to the ability to remove the feed hopper 31 without removing the extension hopper 33. Referring also to FIGS. 2–4, 6 and 11–13, an extension hopper 33 is mounted in material-feeding relationship to the feed hopper 31 and includes a mounting component 75. Such component 75 has a circular mounting ring 77, a circular extension hopper flange 79 spaced below the ring 77 and a cylinder-like component body 81 extending between and rigidly joining the ring 77 and the flange 79. The diameters of the mounting ring 77 and the aperture 29 in the upper support member 27 are cooperatively selected so that the ring 77 sits atop such member 27 and cannot pass through the aperture 29. The extension hopper 33 is mounted to the member 27 by fasteners, e.g., bolts or the like, extending through the ring 77 and the member 27. The diameters of the aperture 29 and the flange 79 are selected so that the flange 79 is laterally coextensive with the feed hopper flange 35 and the flange 79 "clears" the aperture 29 and can be lifted out therethrough when the extension 33 hopper is removed from the support structure.

(Persons of ordinary skill will appreciate that an aperture 29 and flanges 35, 79 which are round are preferred. However, an aperture and flanges having other shapes may be used. Of course, it is preferable to maintain the described dimensional relationships to permit easy extension hopper mounting and withdrawal.)

Referring now to FIGS. 3–6 and 11–15 the hoppers 31, 33 are joined to one another at a hopper joint 83 which is below the upper member 27 of the support structure 11. And as noted above, the flange 35 of the hopper 31 is below such member 27. A securing device 85 is in overlapping relationship to the flanges 35, 79, thereby fastening the hoppers 31, 33 to one another. In a highly preferred embodiment, the securing device 85 is a circular hoop which overlaps with both flanges 35, 79 and, when the securing bolt 87 (or other suitable securing mechanism, e.g., a toggle latch) is tightened, the device 85 secures both flanges 35, 79 to one another. In a preferred construction, there is a resilient seal ring 89 between the flanges 35, 79. Where the feed hopper 31 is made of flexible material, the ring 89 is molded integrally with the body 37 and the flange 35. But where the hopper 31 is rigid, such ring 89 is a separate component.

As shown in FIGS. 11–13, 16 and 17, the extension hopper 33 has an upper edge 91 and a lower mouth 93. At any one of plural section planes 16—16, 17—17 taken between the upper edge 91 and the lower mouth 93 and oriented perpendicular to the vertical axis 13, the cross-sectional shape of the extension hopper 33 is circular.

Referring next to FIGS. 2, 4, 7, 18 and 19, the feed hopper 31 includes a driven conveyor such as the auger 41 mentioned above. A conveyor drive unit 95, e.g., an electric motor 97 and speed reducer 99, is supported by the structure 11. While the drive unit 95 may take any of a number of configurations and be mounted in any of several ways (some of which may not obstruct the lateral opening 69), a preferred way is to mount the unit 95 for pivoting movement between a conveyor drive position shown in FIG. 2 and a hopper-removing position shown in FIG. 4.

The auger 41 includes an auger-driving shaft 101 having a pair of drive studs 103 protruding therefrom and the drive unit 95 includes a rotating drive head 105 which has a slot 107 to engage the studs 103. The studs 103 and slot 107 are cooperatively sized and located so that the slot 107 may come into registry with and engage the studs 103 when the drive unit 95 is pivoted in the direction indicated by the arrow 109.

A significant advantage of the new system 10 is that the feed hopper 31 can be removed for hopper or auger maintenance without removing any extension hopper 33 which may be attached thereto. Another advantage is that if the feed hopper 31 needs to be removed, the nozzle 45 between the feed hopper 31 and the process equipment being fed by the system 10 need not be moved or, at most, needs only minimal time and effort to disconnect such nozzle 45 from the hopper 31. And the feed and extension hoppers 31, 33 can be easily joined to one another and, just as easily, the extension hopper 33 can be removed from the support structure 11, if necessary.

Figure 20:
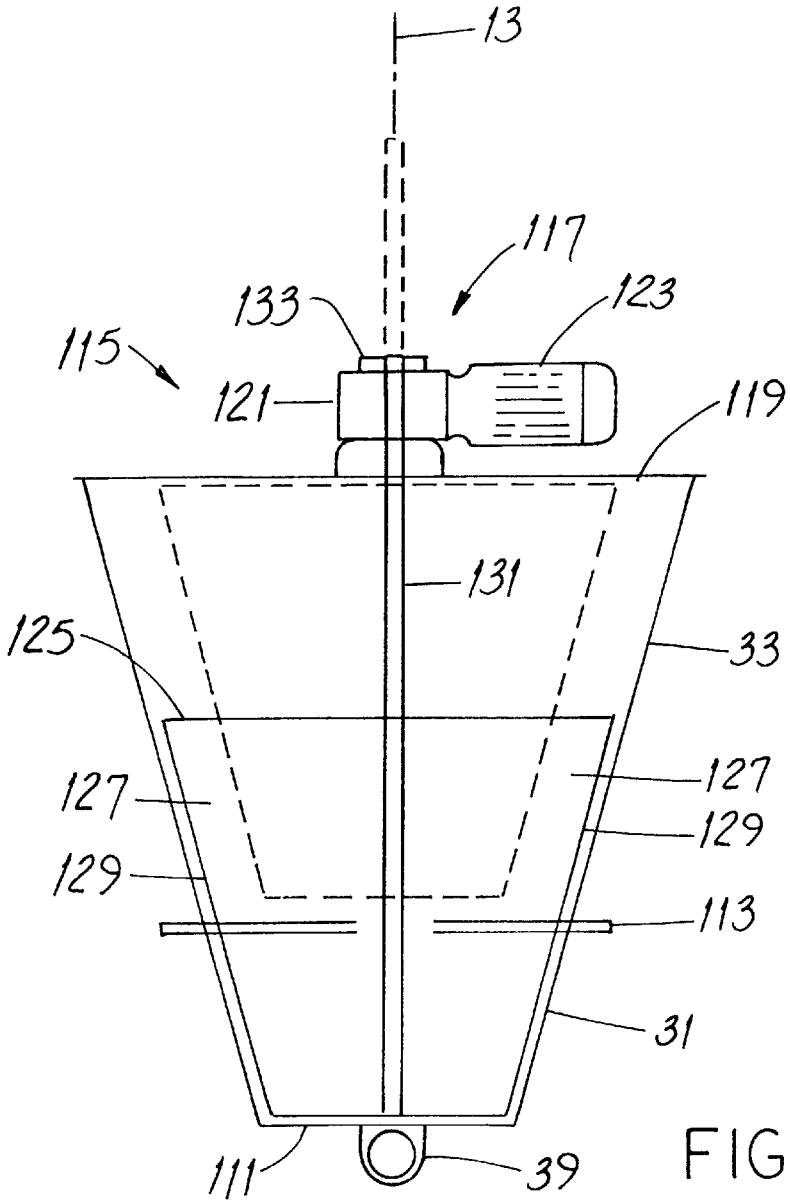
FIG. 20 is a representative elevation view of a rigid feed hopper, extension hopper and stirring mechanism used in another embodiment of the system.
Figure 18:
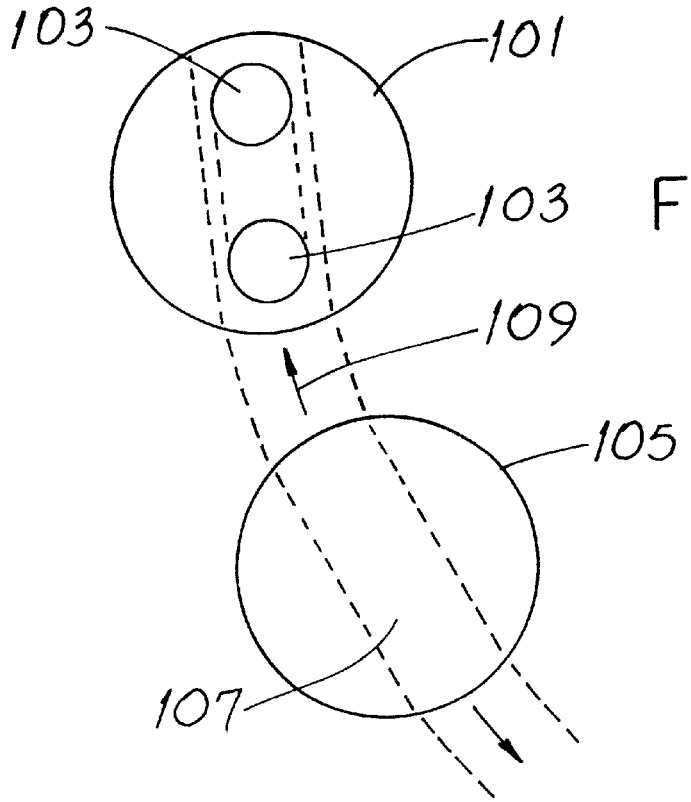
FIG. 18 is a representative elevation view depicting certain relationships between the driven shaft and the drive device used in the new system.
Figure 19:
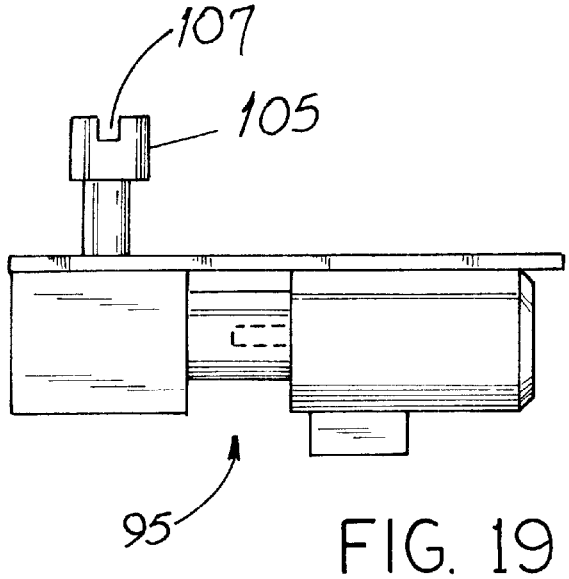
FIG. 19 is a top plan view of the drive unit shown in FIGS. 2 and 4. Surfaces of the electric motor shaft are shown in dashed outline.

In the embodiment of FIG. 20, the feed hopper 31 is made of a rigid material, e.g., stainless steel, rather than of a flexible material. Most preferably, the extension hopper 33 is also made of stainless steel as in the embodiment of FIGS. 2–4. A preferred feed hopper 31 is shaped like an inverted truncated cone. That is, such hopper has a sidewall which tapers inwardly and downwardly and which is of circular cross-sectional shape along substantially all of its height. But for the duct 39 described above, the hopper bottom 111 is substantially flat and perpendicular to the vertical axis 13. The structure at 113 represents the upper flange 35 of the feed hopper 31.

Free flow of material in the hopper 31 is promoted by a stirring mechanism 115, parts of which are within the hopper 31. The stirring mechanism 115 includes a drive unit 117 supported by and atop a cover 119 on the extension hopper 33. Such drive unit 117 includes a right-angle speed reducer 121, preferably of the hollow shaft type, and an electric drive motor 123. A stirring device 125 is used to promote mass flow and an exemplary device 125 includes a pair of radially extending blades 127. The blade edges 129 are located and configured to closely conform to the shape of the hopper 31 while yet avoiding contacting such hopper 31 along either the sidewall or the bottom.

An elongated power shaft 131 is rigidly affixed to the stirring device 125, extends upwardly and is in driven engagement with the drive unit 117. In an exemplary embodiment, the shaft 131 cannot rotate independently of the speed reducer 121 but is configured to slide axially therewithin. (As examples, a key or spline coupling meets these parameters.)

By using an exemplary coupling collar 133, the stirring device 125 (with its shaft 131) are, during operation, held at predetermined locations, shown in FIG. 20 in solid outline, in the feed hopper 31. And when it is desired to withdraw the feed hopper 31, the collar 133 is loosened, the stirring device 125 and shaft 131 raised to the positions shown in FIG. 20 in dashed outline, and the collar 133 re-tightened. This not only removes the stirring device 125 from the feed hopper 31, it also conveniently holds such device 125 in an elevated position, pending completion of service work.

While the principles of the inventions have been shown and described in connection with specific embodiments, it is to be understood clearly that such embodiments are by way of example and are not limiting.

What is claimed:

1. A bulk-solid metering system comprising:

a support structure for supporting an extension hopper and a feed hopper mounted with respect thereto, said support structure extending along a substantially vertical axis and having:

first and second opposed sidewalls in fixed relative position and defining sidewall planes;

an upper wall spanning between and secured with respect to the sidewalls, the upper wall defining an aperture adapted to receive the extension hopper mounted with respect thereto;

a front wall spanning between and secured with respect to the sidewalls, said front wall defining an opening through which bulk-solid material is discharged;

the sidewalls, upper wall and front wall defining a hopper-receiving space adapted to fully enclose the feed hopper; and the sidewalls and upper wall defining a lateral opening along a support structure rear side, the lateral opening allowing movement of the feed hopper into and out of the hopper-receiving space along a laterally-oriented opening axis substantially transverse to the vertical axis for detachable mounting of the feed hopper fully within the support structure, the sidewalls confining substantially the full extent of feed hopper movement into and out of the support structure to movement generally along the laterally-oriented opening axis;

a nozzle secured with respect to the front wall in material-flow relationship with the front wall opening and having a first end adapted to receive the bulk-solid material from the feed hopper, a second end outside the support structure and a bulk-solid material passageway therebetween;

the extension hopper having an upper material inlet, a lower material outlet and an extension hopper flange, said extension hopper being removably mounted with respect to the upper wall such that, when mounted, the extension hopper extends at least partially through the upper wall aperture into the hopper-receiving space between the first and second sidewalls and the extension hopper flange is located below the upper wall in the hopper-receiving space;

the feed hopper having an upper material inlet, a lower material outlet, a feed hopper flange and a duct having a duct axis, a duct top opening in material-flow relationship with the feed hopper lower material outlet, a spout along a first end of the duct and an auger-receiving opening along a second end of the duct, said feed hopper being removably mounted with respect to the support structure by detachable engagement of the extension hopper and feed hopper flanges such that (1) when mounted, the feed hopper is positioned in the hopper-receiving space, the feed hopper upper material inlet is in material-flow relationship with the extension hopper lower material outlet, the duct axis is substantially transverse to the vertical axis and substantially parallel with the laterally-oriented opening axis, and the spout is in material-flow relationship with the nozzle first end, and (2) when demounted, the feed hopper is movable completely into and out of the support structure filly between the sidewalls and generally along the laterally-oriented opening axis;

an auger rotatably mounted in the duct to move the bulk-solid material from the duct top opening into and through the nozzle, said auger having an auger axis substantially coaxial with the duct axis when mounted and being movable into and out of the duct separately from the mounted feed hopper and support structure through the auger-receiving opening, between the sidewalls and along the laterally-oriented opening axis; and a drive unit movably mounted with respect to the support structure on a pivotable mount adapted to permit the drive unit to move in a plane from a first position in power transmission relationship with the mounted auger such that the drive unit rotates the auger and a second position in which the drive unit is decoupled from the auger and is pivoted away from the auger and feed hopper such that the auger is free to be fully withdrawn from the duct and support structure separately from the mounted feed hopper and the feed hopper is free to be fully withdrawn from the support structure;

whereby the feed hopper and auger are mountable and demountable with respect to the support structure rear side fully between the sidewall planes.

2. The system of claim 1 wherein:

the feed hopper has a body made of a flexible elastomeric material, said body having first and second deformable agitator portions;

first and second feed hopper agitators each agitator having spaced apart ends comprising hopper contact portions and being secured with respect to the support structure adjacent a respective agitator portion of the mounted feed hopper on a pivotable mount adapted to permit reciprocating movement of the agitator along an agitator axis angled with respect to the duct axis such that the hopper contact portions contact the agitator portion of the mounted feed hopper to cause localized deformation of the agitator portion; and a drive mechanism in power transmission relationship with each agitator and adapted to reciprocate the agitator.

3. The system of claim 2 wherein the agitator axis and the duct axis are substantially perpendicular to one another.

4. The system of claim 1 wherein:

the extension hopper flange is along the extension hopper lower material outlet;

the feed hopper flange is along a feed hopper upper edge and the feed hopper flange is joined to the extension hopper flange by a securing device at a hopper joint; and the hopper joint is below the upper wall.

5. The system of claim 4 wherein the securing device is a band clamp in overlapping relationship to the flanges, thereby fastening the hoppers to one another.

6. The system of claim 5 wherein:

the feed hopper includes a hopper body made of a flexible elastomeric material; and the feed hopper flange is made of a rigid material and is secured to the feed hopper body by the flexible elastomeric material.

7. The system of claim 5 wherein:

a resilient sealing ring is compressed between the flanges; and the extension hopper has a mounting member removably affixed to the upper wall.

8. The system of claim 4 wherein, between the extension hopper upper material inlet and the lower material outlet, the extension hopper has a cross-sectional shape which is circular.

9. The system of claim 4 wherein:

the feed hopper is made of a rigid material;

a stirring mechanism is supported by the extension hopper and includes a drive unit, a stirring device an a power shaft extending between the drive unit and the stirring device; and the power shaft is mounted for movement with respect to the feed hopper, thereby permitting the stirring device to be removed from the feed hopper.

10. The system of claim 9 wherein:

the drive unit and the power shaft are coupled to one another by a sliding coupling, thereby permitting the power shaft to move upwardly through the drive unit.

11. The system of claim 1 wherein:

the feed hopper has a body made of a flexible material, the feed hopper flange is along a feed hopper upper edge and the duct is spaced below the feed hopper flange; and the body has a first cross-sectional shape adjacent to the feed hopper flange and has a second cross-sectional shape intermediate the feed hopper flange and the duct.

12. The system of claim 11 wherein the first cross-sectional shape is circular.

13. The system of claim 11 wherein the second cross-sectional shape has a longitudinal axis and a lateral axis perpendicular to and shorter than the longitudinal axis.

14. The system of claim 12, wherein the second cross-sectional shape has a longitudinal axis and a lateral axis perpendicular to and shorter than the longitudinal axis.

15. The system of claim 13 wherein the longitudinal axis is substantially parallel to the duct axis.

16. The system of claim 1 wherein the nozzle first end and spout are coaxially engaged in the material-flow relationship when the feed hopper is mounted and are axially displaced when the feed hopper is demounted from the support structure.

17. The apparatus of claim 1 wherein the drive unit comprises a motor and speed reducer supported by the pivotable mount, the speed reducer being coupled to the motor and the auger when the drive unit is in the first position.

18. The system of claim 17 wherein the drive unit pivotable mount is mounted for movement of the drive unit in a substantially vertical plane between the first position and the second position.

19. The system of claim 1 wherein the support structure further includes a pair of opposed support columns each coupled to a respective first or second sidewall and supporting the support structure.

* * * * *

UNITED STATES PATENT AND TRADEMARK OFFICE

CERTIFICATE OF CORRECTION

PATENT NO. : 6,568,567 B2
APPLICATION NO. : 09/248055
DATED : May 27, 2003
INVENTOR(S) : James J. McKenzie et al.

It is certified that error appears in the above-identified patent and that said Letters Patent is hereby corrected as shown below:

Col. 9-10, lines 16-33: should read;

--1. A bulk-solid metering system comprising:
a support structure for supporting an extension hopper and
a feed hopper mounted with respect thereto, said support structure extending along a substantially vertical axis and having:
first and second opposed sidewalls in fixed relative position and defining sidewall planes;
an upper wall spanning between and secured with respect to the sidewalls, the upper wall defining an aperture adapted to receive the extension hopper mounted with respect thereto;
a front wall spanning between and secured with respect to the sidewalls, said front wall defining an opening through which bulk-solid material is discharged;
the sidewalls, upper wall and front wall defining a hopper-receiving space adapted to fully enclose the feed hopper; and
the sidewalls and upper wall defining a lateral opening along a support structure rear side, the lateral opening allowing movement of the feed hopper into and out of the hopper-receiving space along a laterally-oriented opening axis substantially transverse to the vertical axis for detachable mounting of the feed hopper fully within the support structure, the side-walls confining substantially the full extent of feed hopper movement into and out of the support structure to movement generally along the laterally-oriented opening axis;
a nozzle secured with respect to the front wall in material-flow relationship with the front wall opening and having a first end adapted to receive the bulk-solid material from the feed hopper, a second end outside the support structure and a bulk-solid material passageway therebetween;
the extension hopper having an upper material inlet, a lower material outlet and an extension hopper flange, said extension hopper being removably mounted with respect to the upper wall such that, when mounted, the extension hopper extends at least partially through the upper wall aperture into the hopper-receiving space between the first and second sidewalls and the extension hopper flange is located below the upper wall in the hopper-receiving space;

UNITED STATES PATENT AND TRADEMARK OFFICE

CERTIFICATE OF CORRECTION

PATENT NO. : 6,568,567 B2
APPLICATION NO. : 09/248055
DATED : May 27, 2003
INVENTOR(S) : James J. McKenzie et al.

It is certified that error appears in the above-identified patent and that said Letters Patent is hereby corrected as shown below:

Col. 9-10, lines 16-33: should read (cont'd);

the feed hopper having an upper material inlet, a lower material outlet, a feed hopper flange and a duct having a duct axis, a duct top opening in material-flow relationship with the feed hopper lower material outlet, a spout along a first end of the duct and an auger-receiving opening along a second end of the duct, said feed hopper being removably mounted with respect to the support structure by detachable engagement of the extension hopper and feed hopper flanges such that (1) when mounted, the feed hopper is positioned in the hopper-receiving space, the feed hopper upper material inlet is in material-flow relationship with the extension hopper lower material outlet, the duct axis is substantially transverse to the vertical axis and substantially parallel with the laterally-oriented opening axis, and the spout is in material-flow relationship with the nozzle first end, and (2) when demounted, the feed hopper is movable completely into and out of the support structure fully between the sidewalls and generally along the laterally-oriented opening axis;

an auger rotatably mounted in the duct to move the bulk-solid material from the duct top opening into and through the nozzle, said auger having an auger axis substantially coaxial with the duct axis when mounted and being movable into and out of the duct separately from the mounted feed hopper and support structure through the auger-receiving opening, between the side-walls and along the laterally-oriented opening axis; and a drive unit movably mounted with respect to the support structure on a pivotable mount adapted to permit the drive unit to move in a plane from a first position in power transmission relationship with the mounted auger such that the drive unit rotates the auger and a second position in which the drive unit is decoupled from the auger and is pivoted away from the auger and feed hopper such that the auger is free to be fully withdrawn from the duct and support structure separately from the mounted feed hopper and the feed hopper is free to be fully withdrawn from the support structure;

UNITED STATES PATENT AND TRADEMARK OFFICE

CERTIFICATE OF CORRECTION

PATENT NO. : 6,568,567 B2
APPLICATION NO. : 09/248055
DATED : May 27, 2003
INVENTOR(S) : James J. McKenzie et al.

It is certified that error appears in the above-identified patent and that said Letters Patent is hereby corrected as shown below:

Col. 9-10, lines 16-33: should read (cont'd);

whereby the feed hopper and auger are mountable and demountable with respect to the support structure rear side fully between the sidewall planes.--

Signed and Sealed this

Twenty-fifth Day of September, 2007

JON W. DUDAS
*Director of the United States Patent and Trademark Office*